US007263738B2

(12) United States Patent
Moore

(10) Patent No.: US 7,263,738 B2
(45) Date of Patent: Sep. 4, 2007

(54) CLEANING AND SANITIZING DEVICE FOR RAZORS

(76) Inventor: Mark Moore, P.O. Box 12517, Tallahassee, FL (US) 32317

( * ) Notice: Subject to any disclaimer, the term of this patent is extended or adjusted under 35 U.S.C. 154(b) by 258 days.

(21) Appl. No.: 10/825,928

(22) Filed: Apr. 15, 2004

(65) Prior Publication Data

US 2005/0229948 A1 Oct. 20, 2005

(51) Int. Cl.
*A47L 13/02* (2006.01)
*A47L 13/12* (2006.01)

(52) U.S. Cl. ..... 15/111; 15/105; 15/114; 15/236.06; 15/236.08

(58) Field of Classification Search ..... 15/105, 15/111, 113, 114, 160, 236.06, 236.08, 236.09
See application file for complete search history.

(56) References Cited

U.S. PATENT DOCUMENTS

| | | | | | |
|---|---|---|---|---|---|
| 202,410 | A | * | 4/1878 | Cole | 119/612 |
| 1,225,969 | A | | 5/1917 | Kennedy | |
| 2,230,610 | A | * | 2/1941 | Solomon | 15/104.5 |
| 2,837,755 | A | | 6/1958 | Jones | |
| 2,857,608 | A | * | 10/1958 | Schwartz | 15/111 |
| 3,047,896 | A | * | 8/1962 | Gunderson | 15/111 |
| 3,270,363 | A | * | 9/1966 | Harris, Jr. | 15/237 |
| 3,366,987 | A | * | 2/1968 | Giustino | 15/105 |
| 3,467,978 | A | * | 9/1969 | Golden | 15/111 |
| 3,710,413 | A | | 1/1973 | French | |
| 3,968,535 | A | * | 7/1976 | Nichols, Jr. | 15/105 |
| 4,480,387 | A | | 11/1984 | d'Alayer de Costemore d'Arc | |
| 4,858,266 | A | * | 8/1989 | Engstrom | 15/111 |
| 4,890,348 | A | | 1/1990 | Racioppi | |
| 4,937,940 | A | | 7/1990 | Mason | |
| 4,945,598 | A | | 8/1990 | Racioppi | |
| D347,255 | S | * | 5/1994 | Kerr et al. | D21/795 |
| 5,426,811 | A | * | 6/1995 | Walton et al. | 15/236.08 |
| 5,447,572 | A | * | 9/1995 | LaClair | 134/8 |
| 6,015,293 | A | | 1/2000 | Rimkus | |
| 6,112,364 | A | * | 9/2000 | Myers | 15/236.08 |
| 6,131,230 | A | | 10/2000 | Manabat | |
| 6,243,906 | B1 | * | 6/2001 | Holliday et al. | 15/111 |
| 2003/0115699 | A1 | | 6/2003 | Wagstaff | |

* cited by examiner

*Primary Examiner*—Mark Spisich
(74) *Attorney, Agent, or Firm*—Saliwanchik, Lloyd & Saliwanchik

(57) ABSTRACT

A razor cleaning device particularly suited for multi-bladed disposable razors, comprising a brush and at least two sets of teeth supported by a handle. One of the sets of teeth of said device extend from the handle at an oblique angle. The second set of teeth extend from the opposite side of the handle at equal but opposite oblique angles. Therefore, the teeth on each side to point in equal, but opposite directions. Further, the teeth in each set are tapered in a stepwise fashion to coincide with the offset parallel blades of a razor. This allows each set of teeth to align with and clean several blades of the razor simultaneously. A cloth-like tail is also attached to the device for wiping and cleaning the blades and razor during or after cleaning with the brush and teeth.

18 Claims, 8 Drawing Sheets
(5 of 8 Drawing Sheet(s) Filed in Color)

CLEANING AND SANITIZING DEVICE FOR RAZORS

BACKGROUND OF INVENTION

Disposable razors have been in use for many years. Their sophistication has developed over the years from single-blade straight razors to more modern multiple bladed razors. The new modern multiple blade razors can provide a safer, closer shave and often include such modern improvements as lubricating strips, angled heads, ergonomic handles, and many other features. However, despite improvements, a persistent problem with the multiple blades razors is that they tend to become clogged with shaving cream residue and debris which aids in retaining moisture on the blades, thus promoting rust and generally unsanitary conditions, due to bacterial growth on the blades and blade edge deterioration. This problem can occur with any type of razor, but is usually more of a problem with disposable razors because they cannot be disassembled for adequate cleaning. Using an unsanitary razor to shave, especially delicate skin areas, can promote redness, rashes or other skin irritations, often called "razor burn", usually caused by bacteria present on the razor blades which invade the nicks and cuts produced on the skin during the shaving process. Reducing razor head debris may lead to improved smoothness of shave, improved life of razor head during its useful life, and prolonged useful life of razor. Reduced bacterial-laden debris may lower the incidence of "razor burn" and folliculitis, caused by the introduction of skin bacteria into microscopic razor cuts (nicks).

Common methods for cleaning razors include running hot water over the head of the razor directly from the water tap and/or tapping the head of the razor against a hard object to dislodge debris. However, these techniques do not significantly reduce the debris or bacteria, which accumulate on the blades. Further, rinsing of the blades with water simply increases the moisture on the blades which promotes further bacterial growth. And, tapping the razor against a hard object dislodges only limited amounts of macro debris, does not reduce the bacterial growth, and can damage the razor. Many devices attempt to clean razors with various types of immobile brushes, water jets, picks, etc. But, they tend to be bulky and/or inefficient. Further, they do not reduce the moisture on the blades which promotes bacterial growth and thus unsanitary shaving conditions when next shaving with the same razor.

Until now, there has not been an adequate means for cleaning disposable razors. And, despite advances in the art, methods for sanitizing the blades and reducing bacterial growth on the blades have not been forthcoming.

BRIEF SUMMARY

The subject invention provides a novel handheld device for cleaning the blades of razors. The device of the subject invention is exemplified for use with disposable razors, but can be used for cleaning any type of single or multiple blade razors, disposable or otherwise. The subject device provides a means for cleaning the upper and lower blade surfaces. It also provides a means for cleaning the edges of the blade(s) where they are usually secured to the frame of the razor and most often accumulate debris that is difficult to remove. It is most desirable to keep the entire length of the blade as sharp and clean as possible. It is also advantageous to remove as much moisture as possible before storing the razor. As will be shown, this can reduce bacterial growth on the blades, which provides a more sanitary shaving razor, and can reduce the amount of blade pitting and deterioration caused by rust.

The device of the subject invention has a handle with a brush at one end wherein the bristles of the brush extend vertically from the anterior end of the handle. Also located on the handle are one or more teeth with tapered lengths which are aligned so that the longest tooth is on top and the shortest tooth is on the bottom. In a preferred embodiment, the teeth are tilted at an oblique angle to provide easier insertion between the blades of a razor. Also attached or otherwise affixed to the device is material, for example cloth or sponge, for wiping away water and debris while cleaning the razor, and if desired, applying anti-bacterial agents, chemicals, shaving lubricants, etc.

BRIEF DESCRIPTION OF DRAWINGS

The patent or application file contains drawings executed in color. Copies of this patent or patent application publication with color drawings will be provided by the Office upon request and payment of the necessary fee.

Several of the Figures (e.g.

FIG. 1 is an isometric view of the anterior or head end and the handle of the device of the subject invention.

FIG. 4 illustrates the anterior end of the device of the subject invention. Particularly illustrated are the details of the head of the device, whereby the bristles of the brush are not shown in order that the entire head end can be seen.

FIG. 5 is an enlarged isometric view of the anterior end of the brush. Particularly illustrated is the angling of the teeth of the device of the subject invention.

FIG. 6 is an even more enlarged isometric view of a portion of the head end illustrating the tapering lengths and angling of the teeth of the subject invention.

DETAILED DISCLOSURE

The subject invention concerns a novel device for cleaning single or multiple bladed razors. As used herein, the term "razor" includes disposable or reusable razors with single or multiple blades. The ability to adequately clean razors before or after use can provide a more comfortable and more sanitary shave. Ideally, such a device would be useable with a most types of razors and should provide for thorough cleaning of all blade surfaces.

The device of the subject invention provides a means for cleaning the surfaces of the blade(s) of a razor. As will be disclosed, the device of the subject invention provides not only a means for brushing away loose debris on the surfaces of the blade(s), but also a means for scraping or otherwise loosening hardened, caked, or dried debris which may accumulate on the blades. Particularly provided is a means for cleaning the edges of the blades where they are secured to the frame of the razor and form corners or edges, which easily accumulate debris. The device can also provide a means for reducing moisture on the blades, especially before storage of the razor, which aids in reducing bacterial growth on the blades.

Figure 2:
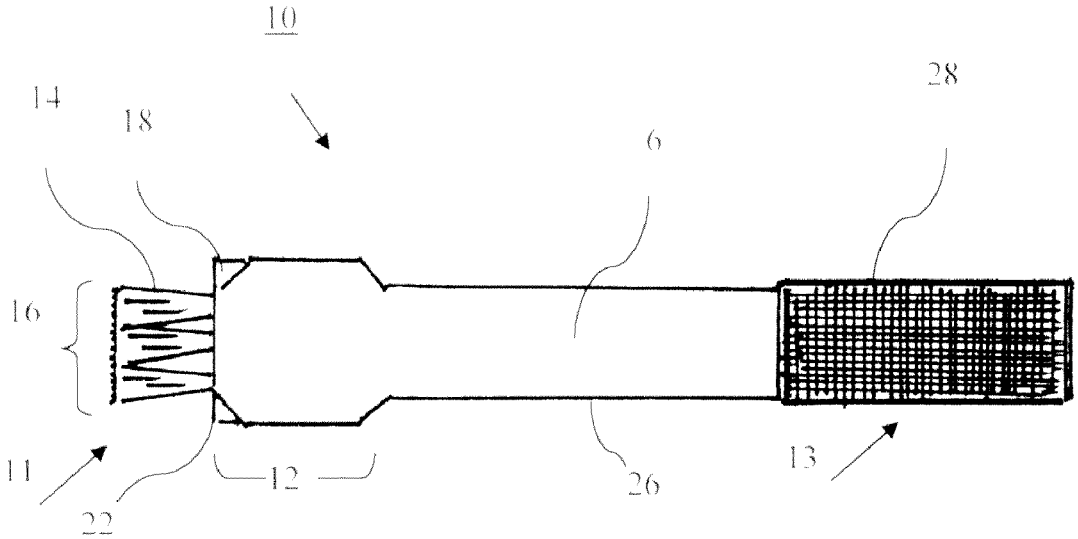
FIG. 2 illustrates a top planar view of the device of the subject invention.

As seen in FIG. 2, the device 10 has a handle 26, which can be of variable length. In addition, the circumferential shape, i.e., cross-section, of the handle can be of various shapes, including, but not limited to, circular, ovate, squared, rectangular, or any multi-sided shape. Further, the handle may have various features or textures to assist in gripping the device, including, but not limited to ridges, indentations, notches, cuttings, markings, logos. Ergonomic considerations may also dictate the shape of the handle. In one embodiment, the handle has one or more flattened sides, to reduce or prevent rolling of the device when laid on a flat surface. In a more preferred embodiment, the device has four flattened sides. In an even more preferred embodiment the device has four flattened sides such that the top 6 and bottom 8 of the handle are wider than the sides of the handle, as shown for example in FIG. 2. This may provide an easier grip on the device and, as mentioned previously, can reduce or prevent the device from rolling when laid on a flat surface.

The device includes one or more brushes for removal of loose material from the blades. It should be understood that the brush or brushes may be of various configurations known in the art. For example, retractable bristles, bristle protectors or covers, replaceable brushes or bristles, as well as other embodiments known in the art may be utilized in the subject invention. The brush or brushes can be located anywhere on the handle of the device. In a preferred embodiment, the device of the subject invention has a brush 16 located on the topmost or anterior 11 edge of the handle. In a more preferred embodiment the bristles 14 of the brush are oriented in the same longitudinal direction as the handle, as illustrated for example in FIGS. 2 and 3. Locating the bristles in this fashion can prevent them from being crushed or disfigured when the device is laid down.

The device also has one or more teeth 24 affixed onto or contiguous with the head 12 or handle 26 of the device. These one or more teeth 24 can be of various uniform or non-uniform lengths and widths. The width 23 of the teeth should allow them to fit within the spaces between the multiple blades of a razor. One skilled in the art would be able to determine the correct width(s) of the teeth based upon well-known standards for positioning the blades in disposable razors to achieve effective cutting technique. In addition, most razors, especially disposable razors, have several rigid supports located along the length near the back of the blades, and at a sufficient distance from the cutting edge so as not to interfere during the shaving process. These supports aid in minimizing bending of the blades during use. The teeth of the subject invention may be of sufficient length to clean the blade surfaces, but avoid being obstructed by these blade supports. Thus, in a preferred embodiment, the portion of the length of the teeth in contact with the blade is between about 0.5 to 5 millimeters. In a more preferred embodiment, the portion of the length of the teeth which is in contact with the blade is between about 1 to 4 millimeters. In an even more preferred embodiment, the portion of the length of the teeth which is in contact with the blade is between about 2 and 3 millimeters. The circumferential shape of the teeth can vary from a rounded or ovate shape to one which is more straight-sided or squared. Depending upon the configuration of the one or more teeth, they may be attached to or contiguous with the handle in a variety of ways. In a preferred embodiment, a tooth can be located at one end to the handle of the device, such that the tooth projects away from the handle, in a bristle-like manner. In an alternative preferred embodiment, the tooth may be somewhat triangular in shape, wherein the base of the triangle can be attached to or contiguous with the handle of the device and the apex of the triangle may project away from the handle to form a bristle-like tooth, similar to that illustrated in FIGS. 2 and 7.

In addition, in order to accommodate a variety of methods for holding the device, it may be advantageous to have teeth located in different areas or orientations on the device. It is even advantageous to have one or more teeth arranged so that they can be used to clean more than one blade either simultaneously or sequentially. In one embodiment, the device may have two or more teeth, arranged around or along the handle of the device, which can be used one at a time in a sequential or non-sequential method to clean the blades of a razor. In a preferred embodiment, the two or more teeth may be arranged on the device of the subject invention such that they can be used simultaneously for cleaning the one or more blades of a razor.

Figure 4:
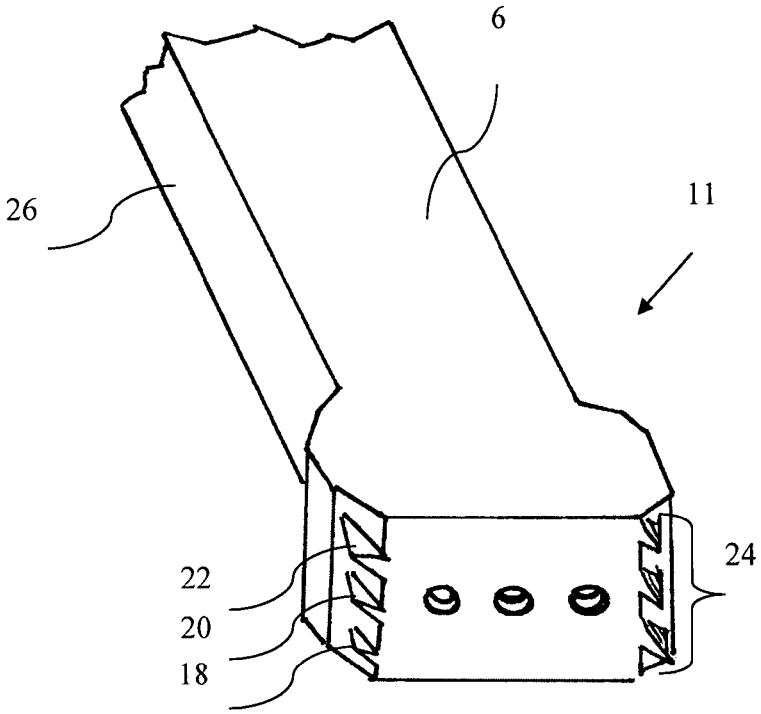
Figure 5:
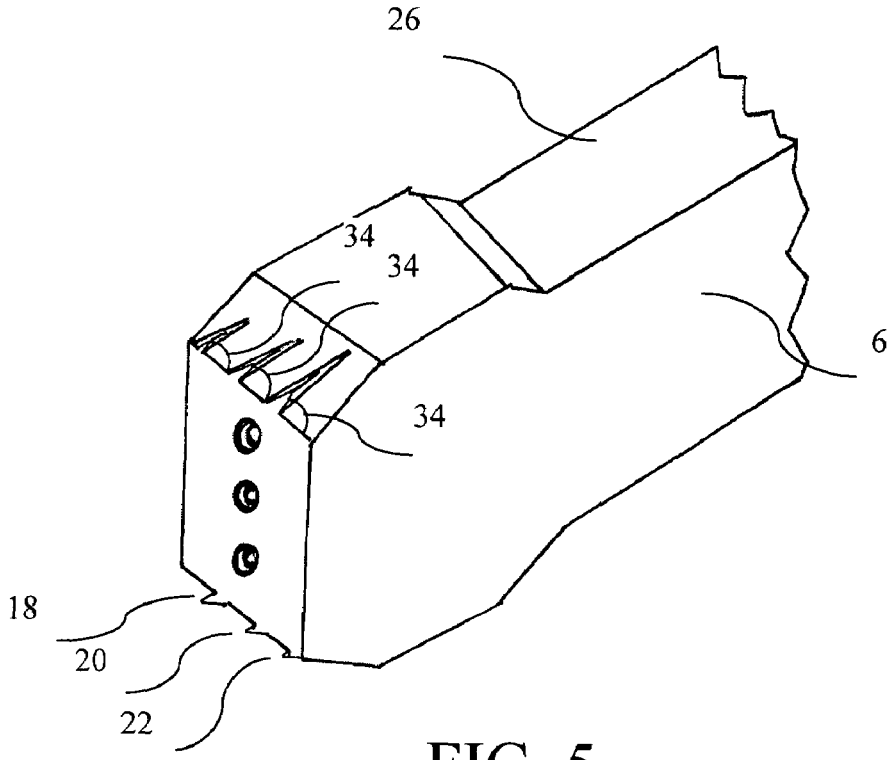
Figure 8:
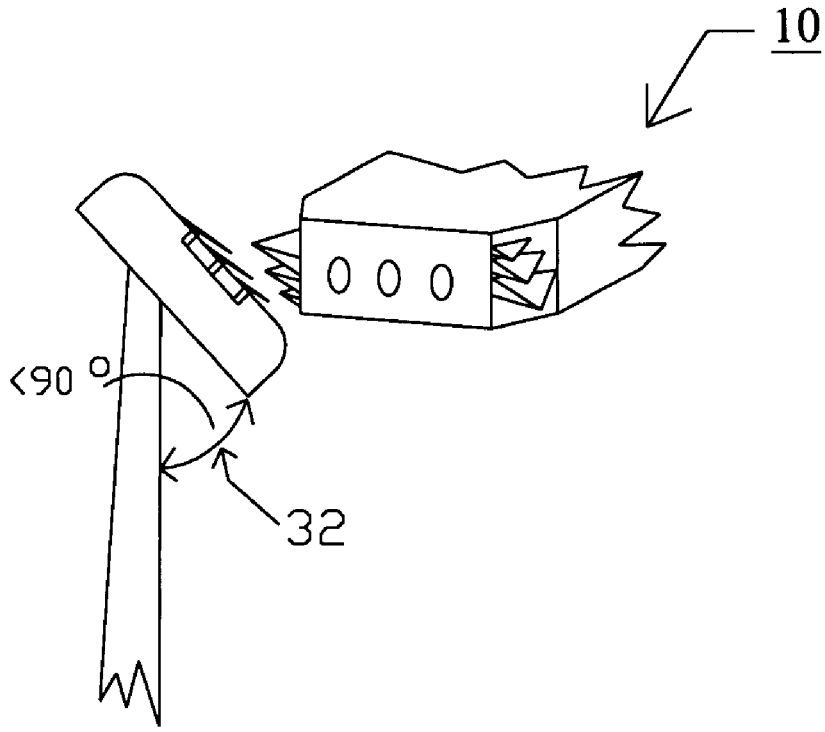
FIG. 8 illustrates how the device of the subject invention is used to clean the blades of a razor, particularly how the teeth of the subject invention may be angled to essentially coincide with the angling of the blades of a typical razor.
Figure 9:
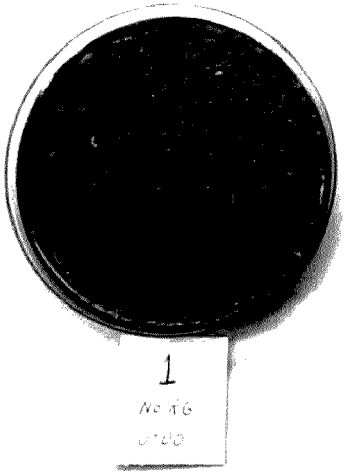
FIG. 9 is a photograph of a blood agar plate after a 24 hour period, showing the bacterial colony growth cultured from a razor that was used once and then cleaned with tap water. It can be seen that the bacterial colonies are too numerous to count.
Figure 10:
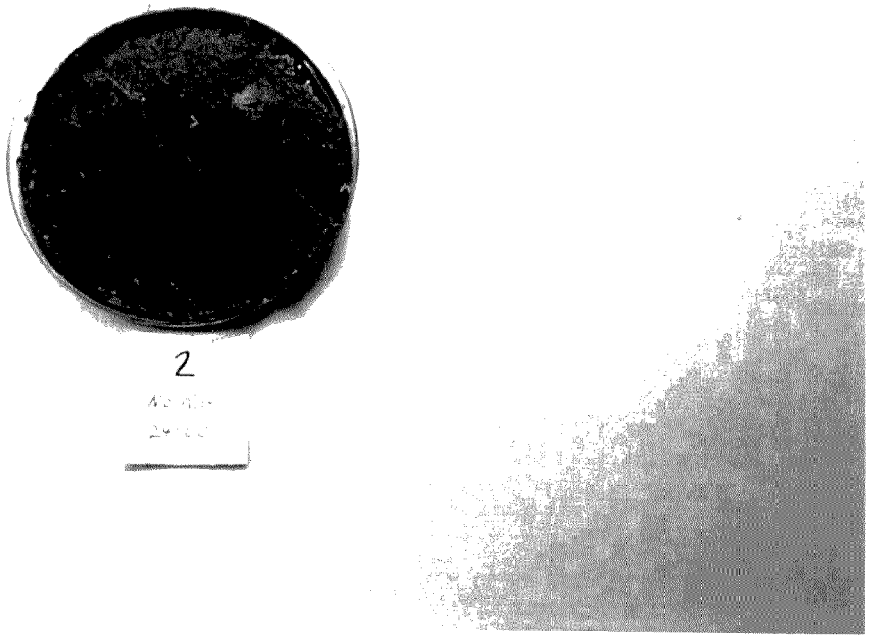
FIG. 10 is a photograph of a blood agar plate after a 24 hour period, showing the bacterial colony growth cultured from a razor that was used once, cleaned with tap water and stored for 24 hours before plating colonies onto agar. It can be seen that the bacterial colonies are more numerous than those shown in FIG. 9.
Figure 11:
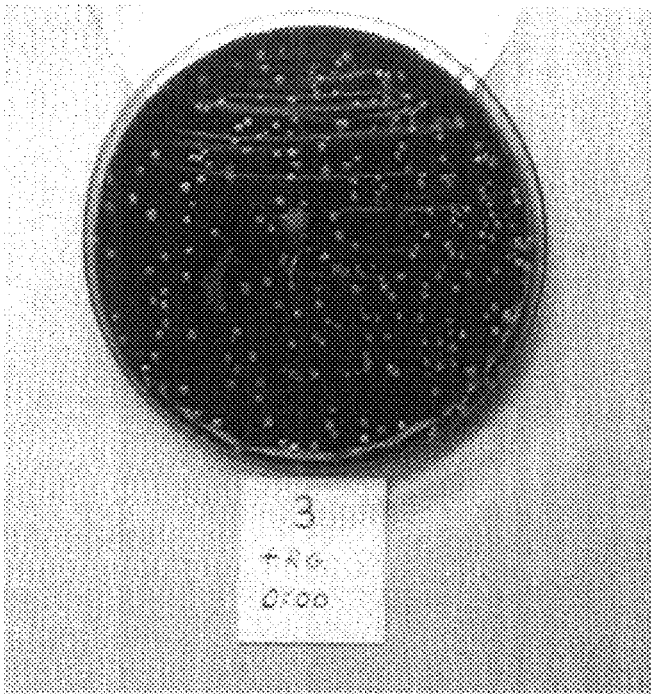
FIG. 11 is a photograph of a blood agar plate after a 24 hour period, showing bacterial colony growth cultured from a razor that was used once and then cleaned with tap water and the teeth of the device of the subject invention.
Figure 12:
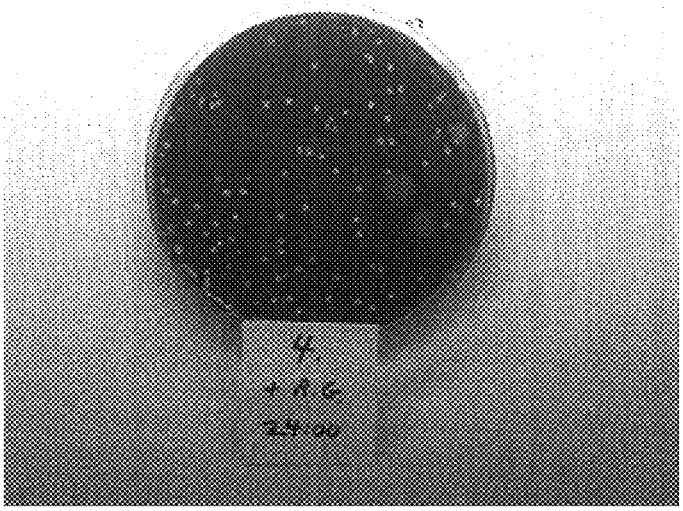
FIG. 12 is a photograph of a blood agar plate after a 24 hour period, showing bacterial colony growth cultured from a razor that was used once, then cleaned with tap water and the device of the subject invention, and stored for 24 hours before plating colonies onto agar.
Figure 13:
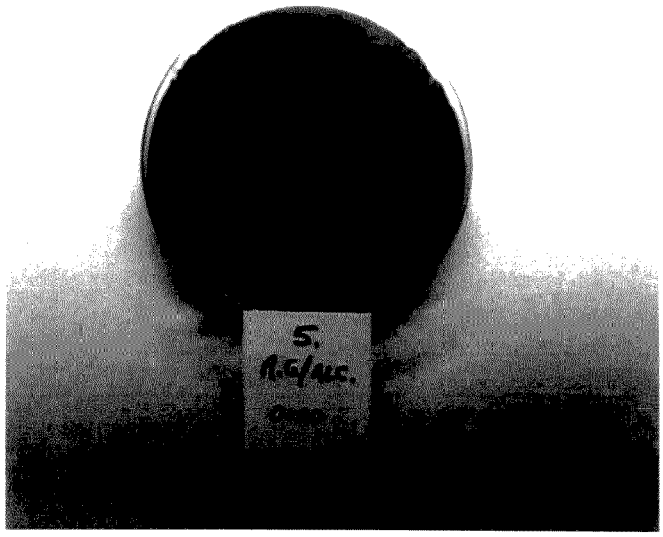
FIG. 13 is a photograph of a blood agar plate after a 24 hour period, showing bacterial colony growth cultured from a razor that was used once, cleaned with tap water and the device of the subject invention, and then wiped with the alcohol moistened material attached to the device of the subject invention.
Figure 14:
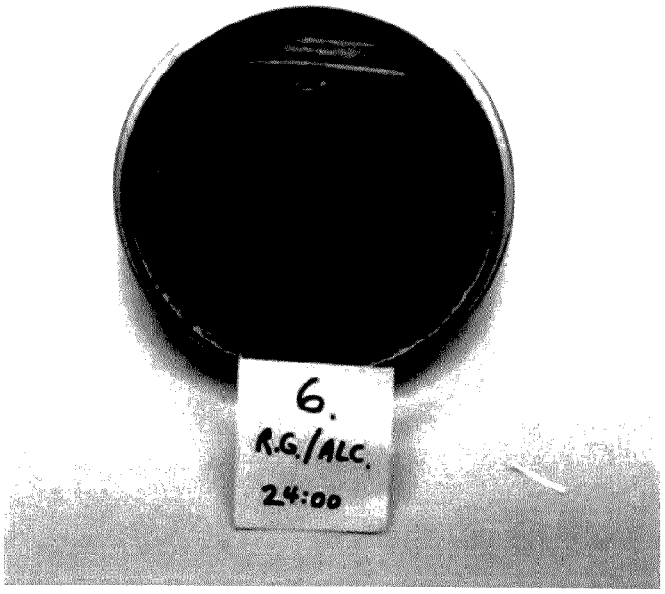
FIG. 14 is a photograph of a blood agar plate after a 24 hour period, showing bacterial colony growth cultured from a razor that was used once, cleaned with tap water and the device of the subject invention, wiped with the alcohol-moistened material attached to the device of the subject invention, and stored for 24 hours before plating colonies onto agar.

In a more preferred embodiment, the device includes a set of three teeth 24. In a further preferred embodiment, there are one or more sets of teeth located on the device. In a still more preferred embodiment there two sets of teeth on the device. In yet another more preferred embodiment the sets of teeth are located on the same end of the device as the brush, see for example FIGS. 4 and 5. In yet a further preferred embodiment, the teeth are positioned parallel to each other in a stacked, generally vertical fashion, as shown in FIGS. 4 and 5, so as to simultaneously clean more than one blade of a razor. In yet another preferred embodiment, the multiple parallel teeth 24 of the device of the subject invention may be of variable lengths, as shown in FIG. 4 such that there can be a longer length tooth 18, a middle length tooth 20, and a shorter length tooth 22. It is well known that many disposable razors have multiple, parallel blades 30, and that the blades are typically set back from one another, usually an even distance, and arranged in a staggered or in stepwise fashion, as illustrated in FIG. 8. Each tooth of the device of the subject invention may be of progressively differing lengths also arranged in a stepwise fashion, as shown in FIG. 8. However, the stepwise progression of the teeth of the subject invention is essentially opposite the stepwise progression of the blades of a typical razor, again as seen in FIG. 8. This stepwise arrangement of the teeth allows the longest tooth 18 of the device to reach the uppermost blades, which in a typical razor are set further back on the head of the razor relative to the lower most blades, which are reached, respectively, by the middle length teeth 20 and shorter length teeth 22 of the device. Accordingly, the use is able to clean several multiple overlapping blades of a razor simultaneously using one set of teeth.

Figure 7:
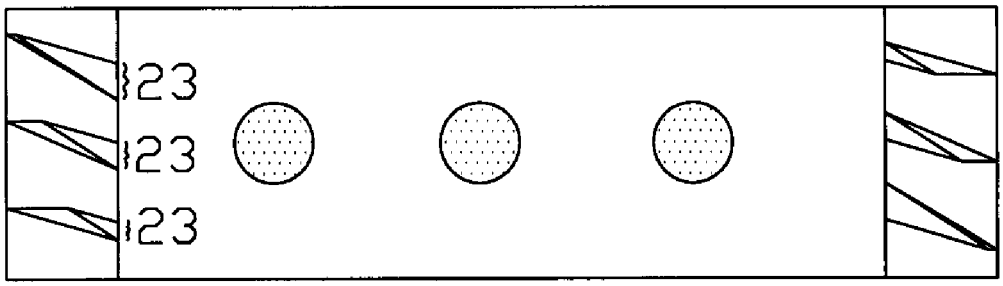
FIG. 7 illustrates a front planar view of the device of the subject invention.

In a preferred embodiment of the subject invention, the one or more teeth of the device project perpendicularly, with respect to a longitudinal plane A-A', that extends through and bisects the head and handle of the device, see FIG. 7. However, it is well known in the art that the head of most razors are slanted such that the angle formed between the handle and plane of the blades housed in the head of a razor, the razor head angle 32, is usually less than 90°. Therefore, in a preferred embodiment, the one or more teeth 24 of the device of the subject invention are slanted at an upwardly oblique angle 34, between 1° and 90°, preferably between 10° and 90°, as formed between the teeth and longitudinal plane A-A', when the teeth are aligned for use to clean a razor. In a more preferred embodiment, the one or more teeth of the device project from the head or handle of the device at an angle, 34 between about 20° to about 70° relative to longitudinal plane A-A',when the teeth are aligned for use in cleaning a razor. In a still further preferred embodiment, the teeth project from the head or handle of the device at an angle 34 between about 30° to about 60°, relative to longitudinal plane A-A' when the teeth are aligned for use in cleaning a razor. In a most preferred embodiment, the one or more teeth of the device project from the head or handle of the device at an angle, 34 between about 40° to about 50° relative to longitudinal plane A-A'when the teeth are aligned for use in cleaning a razor. The angling of the teeth of the device of the subject invention is therefore essentially compatible with the angling of the blades in the head of the razor, as shown for example in FIGS. 7 and 8. This can allow for easier insertion of the teeth between the blades of a razor and decreases the chances of damaging the blades during cleaning the process. In a most preferred embodiment, the device of the subject invention includes two sets of teeth. And, in still another preferred embodiment, as shown in FIGS. 7 and 8, each set of teeth on the device is angled, relative to longitudinal plane A-A' when the teeth are aligned for use, in equal but opposite directions. The most ergonomically natural way to hold the device, illustrated in the Figures, is with the top side 6 and the bottom side 8 of the handle held between the thump and one or more index figures. By arranging the sets of teeth in equal, but opposite, directions, it usually does not matter whether the top side 6 or the bottom side 8 of the handle is in contact with the thumb or index figures, as there will be at least one of the sets of teeth optimally aligned for cleaning a razor. As mentioned above, the handle can be of various shapes, sizes and lengths. But, in general and regardless of the handle configurations, there should be a set of teeth properly aligned for use without adjusting or changing the user's hold or grip on the device. Therefore, it may be necessary to have two or more sets of teeth on the device in order to accommodate various grips afforded by different handle configurations.

Figure 3:
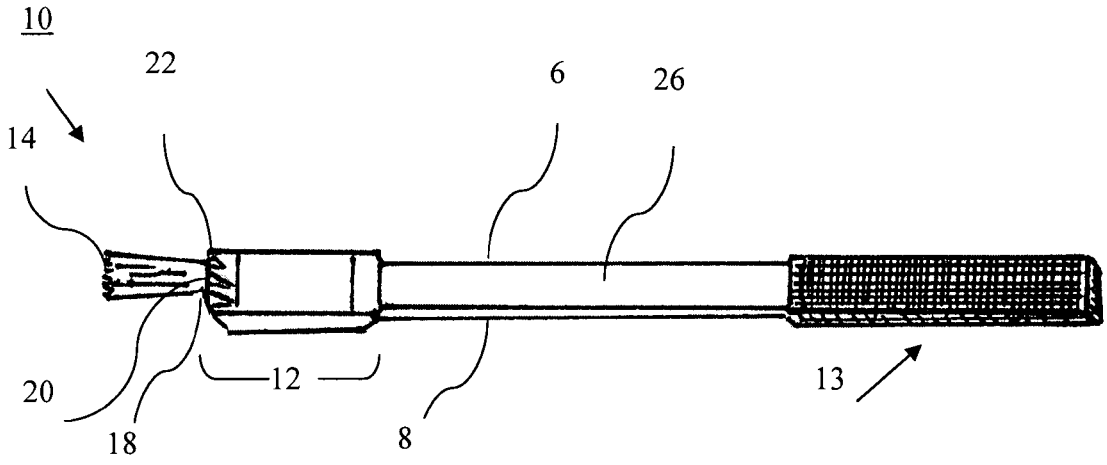
FIG. 3 illustrates a perspective side view of the device of the subject invention.

The device of the subject invention can also have a means for wiping or cleaning water and debris from the blades and razor as part of the cleaning process. For example, a cleaning/wiping material, e.g., cloth, paper, or sponge, of appropriate size can be attached to, affixed to, or otherwise contiguous with the device for wiping the blades and the razor after it has been cleaned with the brush 16 and teeth 24 of the device. Alternatively, a cleaning/wiping material can be used to apply, or may possibly be impregnated or pre-treated with, a variety of chemicals or compositions which may lubricate the razor or blades, sanitize the blades or otherwise prepare the blades or razor for use or storage. In a preferred embodiment, the cleaning/wiping material is a cloth tail 28 attached to, affixed to or otherwise contiguous with to the posterior end of the handle of the device, as shown in FIGS. 2 and 3.

The following examples illustrate how the device reduces debris and bacterial growth on the blades of a razor.

EXAMPLE 1

A Study of the Reduction in Bacterial Growth on the Blades of a Razor after Using the Device of the Subject Invention.

Figure 6:
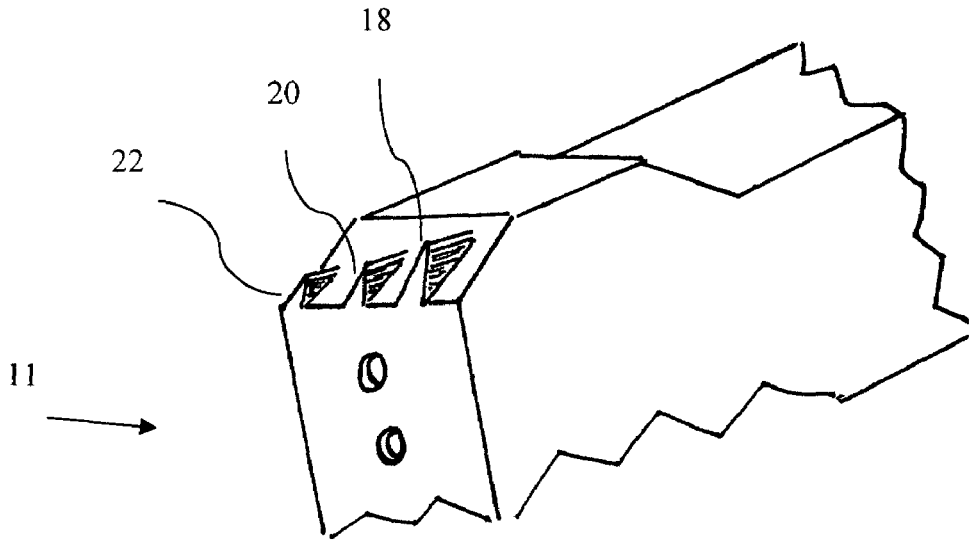

An unblinded, comparative and controlled study was carried out, to show how the use of the device of the subject invention can reduce the gross bacterial contamination present on the blade(s) of a razor immediately after use and at 24 hours. Six sterile Blood Agar plates were labeled as follows:

1. Control—No invention use, Time: 0:00 (FIG. 1)
2. Control—No invention use, Time: 24:00 (FIG. 2)
3. Invention Use, Time: 0:00 (FIG. 3)
4. Invention Use, Time: 24:00 (FIG. 4)
5. Invention Use, Alcohol Applied to Invention Tail, Time: 0:00 (FIG. 5)
6. Invention Use, Alcohol Applied to Invention Tail, Time: 24:00 (FIG. 6)

Terminology:

"control" means simple and usual means of cleaning debris from a razor after use. The head of the razor blade was run under hot water (temperature-100 degrees Fahrenheit), of full faucet pressure, for a total of five seconds.

"invention use" means, the razor head was cleaned with the invention's typical cleaning procedure, while under hot water for five seconds.

"typical cleaning procedure" of the invention involves two swipes with the cleaning teeth, then continued detail cleaning with the bristles, and a final wipe dry with the tail.

"alcohol applied to tail" means the cloth tail was moistened with isopropyl alcohol (rubbing alcohol), before the razor blade received its final wipe.

"time: 0:00" means the agar plate was swabbed with debris from a razor that had just been used.

"time 24:00" means the agar plate was swabbed with debris from a razor that had been used the day before, and left to dry for twenty-four hours under clean conditions.

Methodology:

Six separate disposable razors were used. All were new and in clean condition from a new sealed consumer package. Razors were of the triple blade type. Handles were numbered one through six.

Day 0:

A male face was shaved using a new clean razor from a consumer pack.

Day 1:

The same male face, with one day of beard growth was shaved, using razors #1 (FIG. 1), #3 (FIG. 3), and #5 (FIG. 5) equally. Each razor shaved all areas of the face. Razor #1 was cleaned with standard running water only. Razor #3 was cleaned with the invention under running water, and razor #5 was cleaned with the invention under running water plus an alcohol-moistened tail wipe. They were then stored in a clean, airtight container suspended by the razor handle.

Day 2:

The same male face with one day of beard growth was shaved, with razors #2 (FIG. 2), #4 (FIG. 4), and #6 (FIG. 6) equally. Each razor shaved all areas of the face. Razor #2 was cleaned with standard running water only. Razor #4 was cleaned with the invention under running water, and razor #6 was cleaned with the invention under running water plus and alcohol-moistened tail wipe.

Six sterile swab sticks were used to transfer the individual razor debris from each of the razors #1 through #6 onto the sterile blood agar plates. Each plate had been previously labeled "#1 through #6". Each swabstick was applied to the agar plate in an east-west pattern then crossed-over with a north-south pattern to ensure complete plate coverage. The agar plate's air exposure time in each case was less than thirty seconds. All six plates were placed into a standard incubator, and a colony count read and photographed at twenty-four hours.

Figure 1:
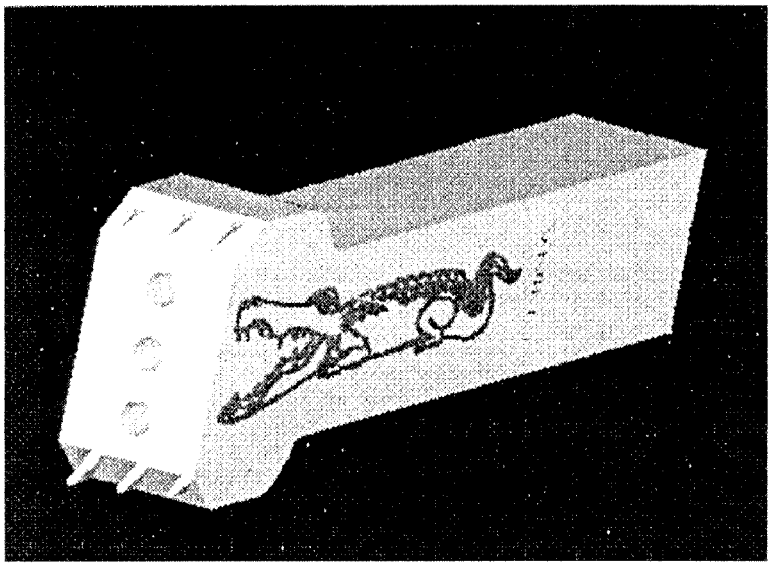
FIGS. 1, 4, 5, 6) illustrate the device without the brush bristles. This is to facilitate viewing the device from all angles without obstructing the head or teeth of the device. It should be understood that the device includes said brush bristles as are described in the specification.

Plate Colony Results:

FIG. 1—Bacterial colonies too numerous to count, greater than 99% gram positive cocci, staphylococci FIG. 2—Bacterial colonies too numerous to count, greater than 99% gram positive cocci, staphylococci FIG. 3—A small number of bacterial colonies, estimated at 7 colonies/square centimeter, staphylococci FIG. 4—A small number of bacterial colonies, estimated at 4 colonies/square centimeter, staphylococci FIG. 5—No bacterial colonies found FIG. 6—No bacterial colonies found In a preferred method for using the device of the subject invention, a shaving razor is held in one hand and the device of the subject invention is held in the opposite hand. Either the brush or the one or more teeth may be used first. The brush is used to clean away loose debris present on the blades. The one or more teeth are placed to come into contact with one or more blades of the razor. The one or more teeth are then slid parallel across one or more surfaces of the blades of the razor to scrape away, or otherwise dislodge debris present on the blades. The brush, teeth and cleaning/wiping material of the device of the subject invention can be used in any preferred order until the blades of the razor are sufficiently cleaned.

In a most preferred method for using the device of the subject invention, a shaving razor is held in one hand and the preferred device of the subject invention is held in the opposite hand. From this position, the brush and the at least one set of parallel, upward obliquely angled teeth, largest tooth topmost, can be used without having to adjust the grip on the device. The brush or the one or more sets of teeth may be used in any order necessary to sufficiently clean the blades of the razor. For example, the brush may be used to clean away loose debris present on the blades. Also, one of the sets of teeth may be aligned with the blades of the razor, as discussed above, and inserted between the blades of the razor. The teeth can then be slid parallel to the surfaces of the blades. As mentioned above, the tapering of the teeth compensates for the overlapping of the blades, such that the longest tooth extends to align with the topmost blade while the shortest tooth is able to align with the bottom blade.

EXAMPLE 2

Measurement of Debris Reduction on Razor Head

Figure 15:
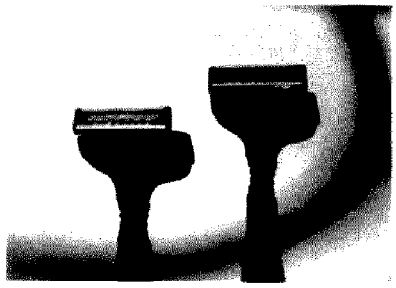
FIG. 15 is a photograph of the two standard double-blade razors described in Example 2. The left razor shows the typical debris on a razor after shaving and rinsing under hot water. The right razor shows a reduction in debris on a razor after rinsing in hot water while using the device of the subject invention to clean the blades.

A comparative study of actual weight of residual shaving debris on razor head after typical use as compared with application of the New Invention Method:

1. Control Razor: One day old beard was shaved in the usual fashion with a double-edged razor. It was run under hot water for 5 seconds (routine cleaning) then, allowed to air-dry for 24 hours, to remove moisture variance. See FIG. 15, left-side razor.
2. Cleaned Razor: One day old beard was shaved in the usual fashion with a double-edged razor. It was run under hot water for 5 seconds in combination with the use of the New Invention, then allowed to air-dry for 24 hours. See FIG. 15, right-side razor.

Debris from the razor heads of each were scraped into Mettler balance weighing vessels, which had been previously weighed for tare.

The results are as follows: weights in micrograms (μg)

Figure 16:
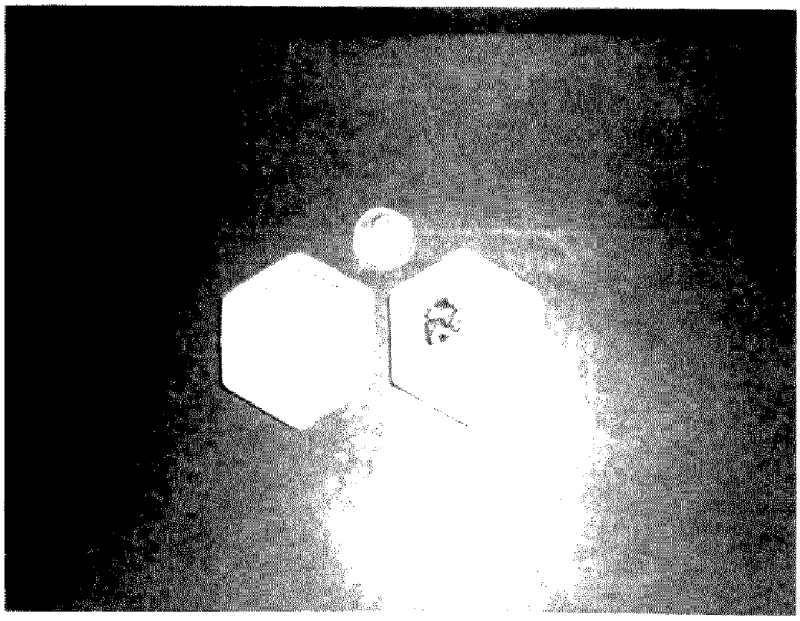
FIG. 16 is a photograph of the amount of debris removed from a razor that was used for shaving, rinsed in hot water and allowed to dry (left side tray), and a razor that was used for shaving, and cleaned with the device of the subject invention while rinsing in hot water, and allowed to dry (right side tray).

| | | | |
|---|---|---|---|
| 1. | Control (subject invention was not used) (FIG. 16, right-side tray) | Total weight: | 651.23 (μg) |
| | | tare: | 535.52 (μg) |
| | | Residual Debris weight: | 115.71 (μg) |

| | | | |
|---|---|---|---|
| 2. | Cleaned Razor (subject invention was used) (FIG. 16, left-side tray) | Total weight: | 537.59 (μg) |
| | | tare: | 536.52 (μg) |
| | | Residual Debris weight: | 1.07 (μg) |

With use of the invention, there was a significant reduction in residual razor debris, as compared with the control. As shown above, approximately 1.07(μg) of debris remained on the blades of the experimental razor cleaned with hot water and the device of the subject invention, as compared with 115.71(μg) of debris which remained on the experimental razor cleaned only with hot water. This represents a greater than 99% reduction in residual razor head debris.

Currently, most disposable razors have at least one blade and some of the more advanced razors have multiple blades. A preferred embodiment of the device of the subject invention can clean up to three blades simultaneously. If there are more than three blades, the device can simply be inserted up or down the head of the razor until all of the blades have been cleaned. This process of brushing the blades and using the teeth to clean the blades can be performed any number of times and in any order necessary until the blades have been sufficiently cleaned of debris. The cloth "tail" of the device can be used to wipe away water and loosened debris during the cleaning process, or as a final step before storing the razor or shaving with it.

It should be understood that the examples and embodiments described herein are for illustrative purposes only and that various modifications or changes in light thereof will be suggested to persons skilled in the art and are to be included within the spirit and purview of this application.

The invention claimed is:

1. A razor cleaning device comprising an elongated handle to which are attached a brush and at least one set of two or more parallel teeth of decreasing lengths, said set of teeth extending from a substantially planar surface of the handle of the device, such that the surface from which the teeth extend is laterally spaced from a longitudinal plane that bisects the handle of the device and extends along the length thereof, further wherein the parallel teeth are aligned, relative to the longitudinal plane, having the longest tooth of a set at the top and the shortest tooth of the same set at the bottom.

2. The razor cleaning device, according to claim 1, wherein the at least two or more teeth project from the handle of the device, at an angle of from about 1°about 90°relative to the longitudinal plane.

3. The razor cleaning device, according to claim 1, wherein the at least two or more teeth project from the handle forming an oblique angle of from about 20° to about 70° relative to the longitudinal plane.

4. The razor cleaning device, according to claim 1, wherein the at least two or more teeth project from the handle forming an oblique angle of from about 30° to about 60° relative to the longitudinal plane.

5. The razor cleaning device, according to claim 1, wherein the at least two or more teeth project from the handle forming an oblique angle of from about 40° to about 50° relative to the longitudinal plane.

6. The razor cleaning device, according to claim 1, wherein some portion of an absorbent material is attached to the handle of the device.

7. The razor cleaning device, according to claim 1, wherein the brush and teeth are located on the same end of the handle.

8. A razor cleaning device comprising a handle to which are attached a brush and at least two sets of three parallel teeth of decreasing lengths, such that, when vertically aligned, at least one of the sets of teeth are arranged with the longest tooth on the top and shortest tooth on the bottom.

9. The razor cleaning device, according to claim 8, wherein the at least two sets of parallel teeth project from the handle of the device, such that the intersection of at least one of the sets of teeth with the handle of the device form oblique angles of from about 1° to about 90°.

10. The razor cleaning device, according to claim 8, wherein the at least two sets of parallel teeth project from the handle of the device, such that the intersection of at least one of the sets of teeth with the handle of the device form oblique angles of from about 20° to about 70°.

11. The razor cleaning device, according to claim 8, wherein the at least two sets of parallel teeth project from the handle of the device, such that the intersection of at least one of the sets of teeth with the handle of the device form oblique angles of from about 30°to about 60°.

12. The razor cleaning device, according to claim 8, wherein the at least two sets of parallel teeth project from the handle of the device, such that the intersection of at least one of the sets of teeth with the handle of the device form oblique angles of from about 40° to about 50°.

13. The razor cleaning device, according to claim 8, wherein some portion of an absorbent material is attached to the handle of the device.

14. A razor cleaning device comprising a handle to which are attached a brush and at least two sets of three parallel teeth of decreasing lengths such that, when vertically aligned, at least one of the sets of teeth is arranged with the longest tooth at the top and shortest tooth at the bottom, and at least one other set of teeth is arranged with the shortest tooth at the top and the longest tooth at the bottom.

15. The razor cleaning device, according to claim 14, wherein the teeth of at least one set of parallel teeth project from the handle at an oblique angle from about 1° to about 90° in the direction of the largest tooth.

16. The razor cleaning device, according to claim 14, wherein the teeth of at least one set of parallel teeth project from the handle at an oblique angle from about 20° to about 70° in the direction of the largest tooth.

17. The razor cleaning device, according to claim 14, wherein the teeth of at least one set of parallel teeth project from the handle at an oblique angle from about 30° to about 60° in the direction of the largest tooth.

18. The razor cleaning device, according to claim 14, wherein the teeth of at least one set of parallel teeth project from the handle at an oblique angle from about 40° to about 50° in the direction of the largest tooth.

* * * * *